US007304633B2

(12) United States Patent
Kim et al.

(10) Patent No.: US 7,304,633 B2
(45) Date of Patent: Dec. 4, 2007

(54) INVERTER DEVICE, LIQUID CRYSTAL DISPLAY DEVICE USING THE INVERTER DEVICE, AND METHOD OF MONITORING LAMPS OF THE LIQUID CRYSTAL DISPLAY DEVICE USING THE INVERTER DEVICE

(75) Inventors: Young Man Kim, Kyoungsangbuk-do (KR); Jung Gun Lee, Kyoungsangbuk-do (KR)

(73) Assignee: LG.Philips Co., Ltd., Seoul (KR)

( * ) Notice: Subject to any disclaimer, the term of this patent is extended or adjusted under 35 U.S.C. 154(b) by 478 days.

(21) Appl. No.: 10/606,832

(22) Filed: Jun. 27, 2003

(65) Prior Publication Data

US 2004/0125071 A1 Jul. 1, 2004

(30) Foreign Application Priority Data

Dec. 26, 2002 (KR) ..... 10-2002-0084621

(51) Int. Cl.
*G09G 3/36* (2006.01)
*G09G 5/00* (2006.01)

(52) U.S. Cl. ..... 345/102; 345/211

(58) Field of Classification Search ..... 345/102, 345/87, 204, 211–212, 84, 30, 55, 48, 50–52, 345/214; 315/247, 278, 308, 176, 291, 307; 363/13, 100, 27–33, 55–58, 40–41, 109, 363/131
See application file for complete search history.

(56) References Cited

U.S. PATENT DOCUMENTS

| | | | | |
|---|---|---|---|---|
| 4,064,414 | A * | 12/1977 | Bergeson et al. | 315/208 |
| 5,420,779 | A * | 5/1995 | Payne | 363/56.01 |
| 6,023,131 | A * | 2/2000 | Okita | 315/291 |
| 2002/0021097 | A1* | 2/2002 | Ito et al. | 315/291 |
| 2002/0109465 | A1* | 8/2002 | Miyoshi | 315/291 |
| 2003/0001524 | A1* | 1/2003 | Lin et al. | 315/312 |

* cited by examiner

*Primary Examiner*—Amr A. Awad
*Assistant Examiner*—Stephen Sherman
(74) *Attorney, Agent, or Firm*—Morgan, Lewis & Bockius LLP

(57) ABSTRACT

An inverter device for a liquid crystal display includes a transformer for receiving an inverter drive voltage, converting the received drive voltage into an AC lamp drive voltage and supplying the AC lamp drive voltage to a high path of a backlight lamp, a low path switching part selectively connecting a low path of the backlight lamp with a ground voltage source in response to an external inverter ON/OFF signal, and a shutdown circuit for receiving a voltage input through the low path of the backlight lamp to monitor for a malfunction of the backlight lamp in response to an external shutdown ON/OFF signal.

2 Claims, 6 Drawing Sheets

INVERTER DEVICE, LIQUID CRYSTAL DISPLAY DEVICE USING THE INVERTER DEVICE, AND METHOD OF MONITORING LAMPS OF THE LIQUID CRYSTAL DISPLAY DEVICE USING THE INVERTER DEVICE

The present application claims the benefit of Korean Patent Application No. P2002-084621 filed on Dec. 26, 2002 in Korea, which is hereby incorporated by reference.

BACKGROUND OF THE INVENTION

1. Field of the Invention

The present invention relates to an inverter device, a display device, and a method of monitoring the display device and more particularly to an inverter device, a liquid crystal display device using an inverter, and method of monitoring lamps of a liquid crystal display device using the inverter device.

2. Description of the Related Art

In general, liquid crystal display (LCD) devices control light transmittance that is supplied from a backlight device to a liquid crystal display panel device to display image date (i.e., a picture) on a display screen. The liquid crystal display panel device includes a plurality of liquid crystal cells arranged in a matrix configuration and a plurality of control switches to switch video signals supplied to each of the liquid crystal cells. Since LCD devices can be made relatively smaller that cathode ray tube (CRT) devices, LCD devices are commonly used in laptop and desktop computers, photocopying machines, mobile telephones, and personal digital assistant (PDA) devices. The LCD devices require a backlight device used as a light source and optical sheets to reduce light loss generated in the backlight device.

The LCD device can be classified into direct-type backlight devices and edge-type backlight devices. The direct-type backlight devices include fluorescent lamps that are positioned to provide uniform light across an entire back surface of a display panel using a diffusion plate. The edge-type backlight devices include fluorescent lamps that are positioned to provide light incident to the display panel through a light guide panel, and are fastened to a side surface of the light guide panel to uniformly disperse light throughout the light guide panel and are surrounded by a lamp housing. The lamp housing supports the fluorescent lamps and prevents the light generated by the fluorescent lamp from leaking to side surfaces of the lamp housing. The diffusion plate is disposed between the display panel and top surfaces of the light guide panel, wherein the display panel includes a lower substrate where thin film transistors and pixel electrodes are arranged, an upper substrate where a color filter is formed, and liquid crystal material layer disposed between the lower and upper substrates. A reflective plate is included to prevent light from leaking onto a lower portion of the light guide panel. Cold cathode fluorescent lamps (CCFLs) or halogen cathode fluorescent lamps (HCFLs) can be used as the fluorescent lamps.

FIG. 1 is perspective view of a backlight device having an HHL-type arrangement of backlight lamps according to the related art. In FIG. 1, a first backlight lamp 10 is electrically connected to a second backlight lamp 12, wherein a low side of each of the first and second backlight lamps 10 and 12 are electrically interconnected to a low power source, and a high side of each of the first and second backlight lamps 10 and 12 are separately connected to a high power source. Accordingly, current flow is through both of the first and second backlight lamps 10 and 12. Thus, if one of the first and second backlight lamps 10 and 12 stops producing light (i.e., stops working), both lamps will stop producing light.

FIG. 2 is a perspective view of a backlight device having an HLHLHL-type arrangement of backlight lamps according to the related art. In FIG. 2, a first backlight lamp 10, a second backlight lamp 12, and a third backlight lamp 14 are each separately connected between high and low power sources. Accordingly, if one of the first, second, and third backlight lamps 10, 12, and 14 stops working, the other ones of the first, second, and third backlight lamps 10, 12, and 14 keeps producing light.

FIG. 3 is a perspective view of a backlight device having an HHHL-type arrangement of backlight lamps according to the related art. In FIG. 3, a first backlight lamp 10, a second backlight lamp 12, and a third backlight lamp 14 have a first end electrically interconnected to a low power source. In addition, each of the a first backlight lamp 10, a second backlight lamp 12, and a third backlight lamp 14 have a second end separately connected to a high power source. Accordingly, if one of the first, second, and third backlight lamps 10, 12, and 14 stops working, the other ones of the first, second, and third backlight lamps 10, 12, and 14 stop producing light. Moreover, it may not be possible to exactly control the current loss generated in an output line or light provided to the reflective plate.

FIG. 4 is a perspective view of currents flow within each of the HHL-type arrangement of backlight lamps according to the related art. In FIG. 4, since the current flowing through the first, second, and third backlight lamps 10, 12, and 14 is the same, it is not possible to exactly control the current loss generated in an output line or the amount light provided to the reflective plate. For example, a current of 6.85 mA flows through the first backlight lamp 10, a current of 8.2 mA flows through the second backlight lamp 12, and a current of 7.2 mA flows through the third backlight lamp 14. Accordingly, since a loss occurs in the output line and the lamp housing and the reflective plate cannot be controlled, it is not possible to make the same current flow through each of the first, second, and third backlight lamps 10, 12, and 14. Thus, characteristics of the first, second, and third backlight lamps 10, 12, and 14 cannot be checked since the amount of current flowing through the first, second, and third backlight lamps 10, 12, and 14 are different.

SUMMARY OF THE INVENTION

Accordingly, the present invention is directed to an inverter device, a liquid crystal display device using an inverter device, and a method of monitoring lamps of the liquid crystal display device using the inverter device that substantially obviates one of more of the problems due to limitations and disadvantages of the related art.

An object of the present invention is to provide an inverter device adaptive for individually monitoring characteristics of a backlight lamp device.

Another object of the present invention is to provide a liquid crystal display device using an inverter for individually monitoring characteristics of a backlight lamp device.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an inverter device for a liquid crystal display includes a transformer for receiving an inverter drive voltage, converting the received drive voltage into an AC lamp drive voltage and supplying the AC lamp drive voltage to a high path of a backlight lamp, a low path switching part selectively connecting a low path of the backlight lamp with a ground voltage source in response to an external inverter ON/OFF signal, and a shutdown circuit for receiving a voltage input through the low path of the backlight lamp to monitor for a malfunction of the backlight lamp in response to an external shutdown ON/OFF signal.

In another aspect, a backlight lamp monitoring device for a liquid crystal display includes a plurality of backlight lamps, and a plurality of inverters, each receiving an inverter drive voltage, converting the received drive voltage into an AC lamp drive voltage, and supplying the AC lamp drive voltage to a high path of each of the backlight lamps, wherein the inverters selectively connect a low path of each of the backlight lamps with a ground voltage source in response to an external inverter ON/OFF signal, and the inverters receive a voltage input through the low path of the backlight lamp to perform a shutdown function for monitoring for the presence or absence of a malfunction of the backlight lamp in response to an external shutdown ON/OFF signal.

In another aspect, a method for monitoring lamp of a liquid crystal display includes receiving an inverter drive voltage, converting the received drive voltage into an AC lamp drive voltage and supplying the AC lamp drive voltage to a high path of a backlight lamp, selectively connecting a low path of the backlight lamp with a ground voltage source in response to an external inverter ON/OFF signal, and receiving a voltage input through the low path of the backlight lamp to monitor for a malfunction of the backlight lamp in response to an external shutdown ON/OFF signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
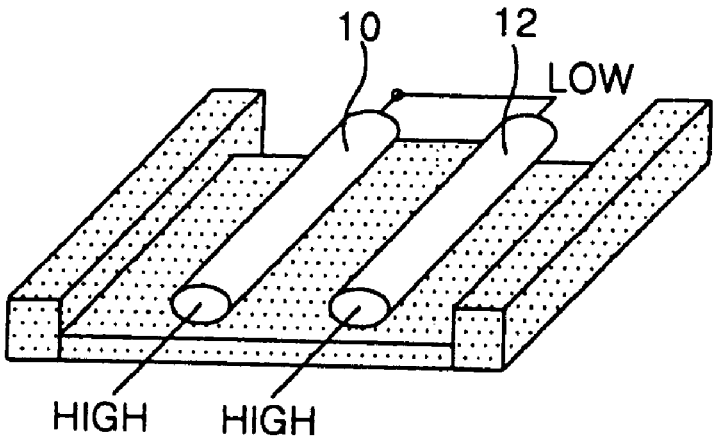
FIG. 1 RELATED ART
FIG. 1 is a perspective view of a backlight device having an HHL-type arrangement of backlight lamps according to the related art.
Figure 2:
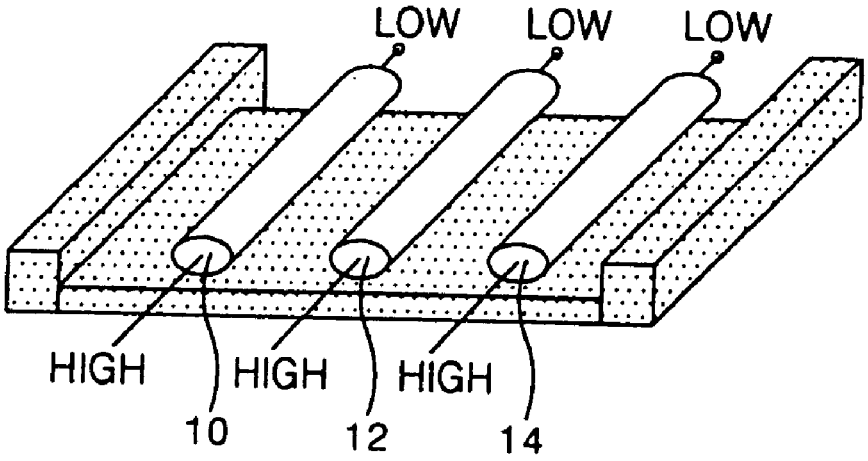
FIG. 2 RELATED ART
FIG. 2 is a perspective view of a backlight device having an HLHLHL-type arrangement of backlight lamps according to the related art.
Figure 3:
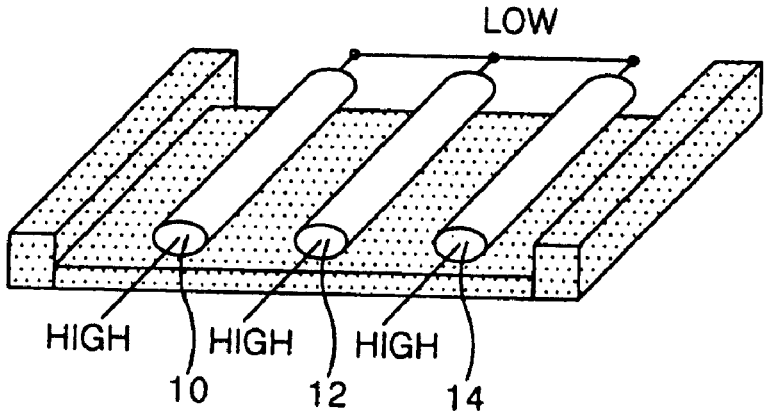
FIG.3 RELATED ART
FIG. 3 is a perspective view of a backlight device having an HHHL-type arrangement of backlight lamps according to the related art.
Figure 4:
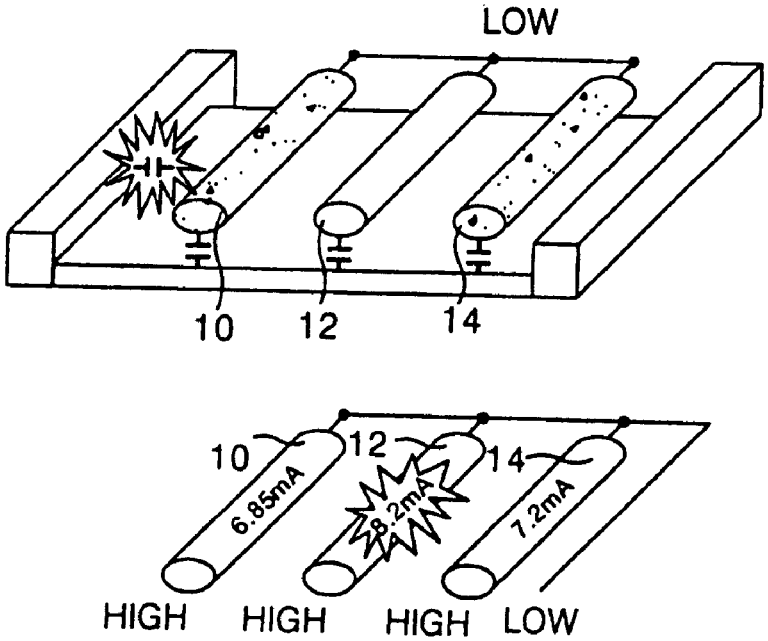
FIG.4 RELATED ART
FIG. 4 is a perspective view of current flow within each of the HHL-type arrangement of backlight lamps according to the related art.
Figure 5:
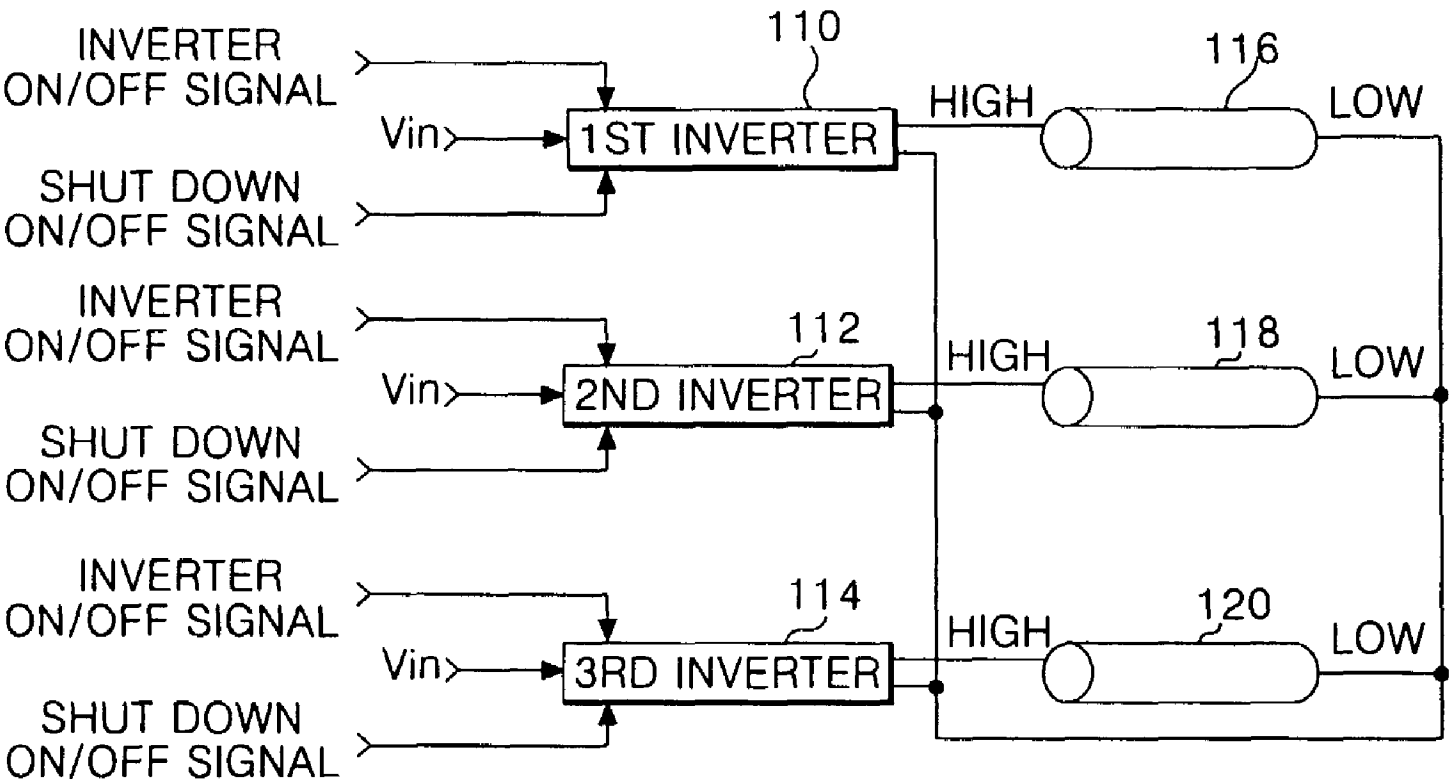
FIG. 5 is a schematic diagram of an exemplary backlight-checking device according to the present invention.

FIG. 5 is a schematic diagram of an exemplary backlight-checking device according to the present invention. In FIG. 5, a backlight monitoring device includes a first inverter 110, a second inverter 112, and a third inverter 114. The first inverter 110 receives and converts inverter drive voltages Vin into alternate currents to supply lamp drive voltages to the first backlight lamp 116. In addition, the first inverter 110 receives external inverter path ON/OFF signals to control current to be flowed to the low path of the first, second, and third backlight lamps 116, 118, and 120, and controls the first backlight lamp 116 to perform a shutdown function by supply of a external shutdown ON/OFF signals.

The second inverter 112 receives and converts the inverter drive voltages Vin into alternate currents to supply the lamp drive voltages to the second backlight lamp 118. In addition, the second inverter 112 receives the inverter ON/OFF signals to control current to be flowed to the low path of the first, second, and third backlight lamps 116, 118, and 120, and controls the second backlight lamp 118 to perform the shutdown function by producing a shutdown function by producing the shutdown ON/OFF signals.

The third inverter 114 receives and converts the inverter drive voltages Vin into alternate currents to supply the lamp drive voltages to the third backlight lamp 120. In addition, the third inverter 114 receives the inverter ON/OFF signals to control current to be flowed to the low path of the third backlight lamp 120, and may control the third backlight lamp 120 to perform the shutdown function by supply of the shutdown ON/OFF signals.

Figure 6:
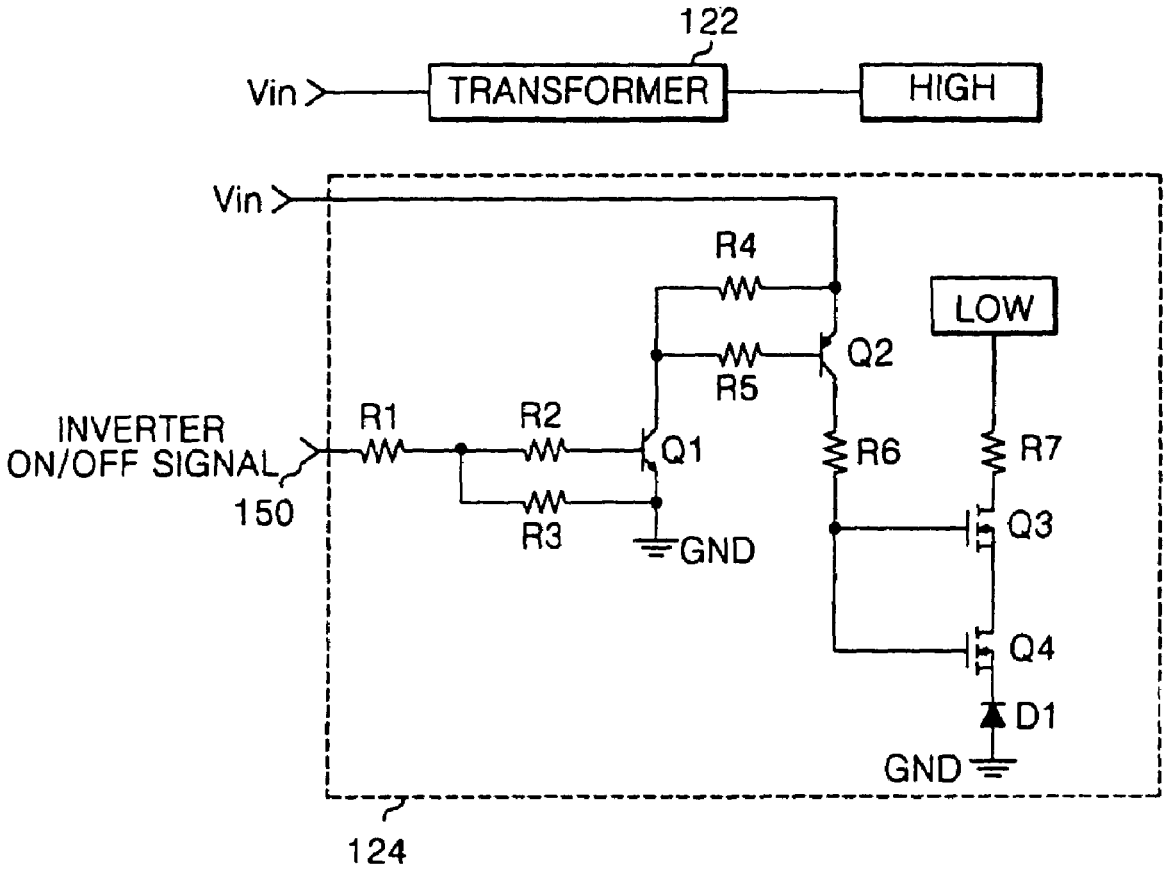
FIG. 6 is a schematic circuit diagram of an exemplary low path switching part as shown in FIG. 5 according to the present invention.

FIG. 6 is a schematic circuit diagram of an exemplary low path switching part as shown in FIG. 5 according to the present invention. In FIG. 6, each of the first, second, and third inverters 110, 112, and 114 (in FIG. 5) includes a transformer 122 that receives and converts the inverter drive voltage Vin into alternate currents to supply lamp drive voltages to the high path of the first, second, and third backlight lamps 116, 118, and 120. In addition, each of the first, second, and third inverter 110, 112, and 114 (in FIG. 5) includes a low path switching part 124 to control the low path of the backlight lamps 116, 118, and 120 (in FIG. 5) by supply of the inverter ON/OFF signals.

In FIG. 6, the low path switching part 124 may include a first resistor R1 and a second resistor R2 connected in series between a first input terminal 150 and a base terminal of a first transistor Q1, a third resistor R3 connected to an emitter terminal of the first transistor Q1 and a connection node between the first and second resistors R1 and R2, a fifth resistor R5 connected between a collector terminal of the first transistor Q1 and a base terminal of a second transistor Q2, a fourth resistor R4 connected between the collector terminal of the first transistor Q1 and an emitter terminal of the second transistor Q2 such that the emitter terminal of the second transistor Q2 is connected to the inverter drive voltage Vin, a sixth resistor R6 connected to a collector terminal of the second transistor Q2 and gate terminals of first and second field effect transistors Q3 and Q4, a seventh resistor R7 connected to the low path of the backlight lamp and a source terminal of the first field effect transistor Q3 such that a source terminal of the second field effect transistor Q4 is connected to a drain terminal of the first field effect transistor Q3, and a diode D1 connected to the drain terminal of the second field effect transistor Q4 so as to be grounded.

Figure 7:
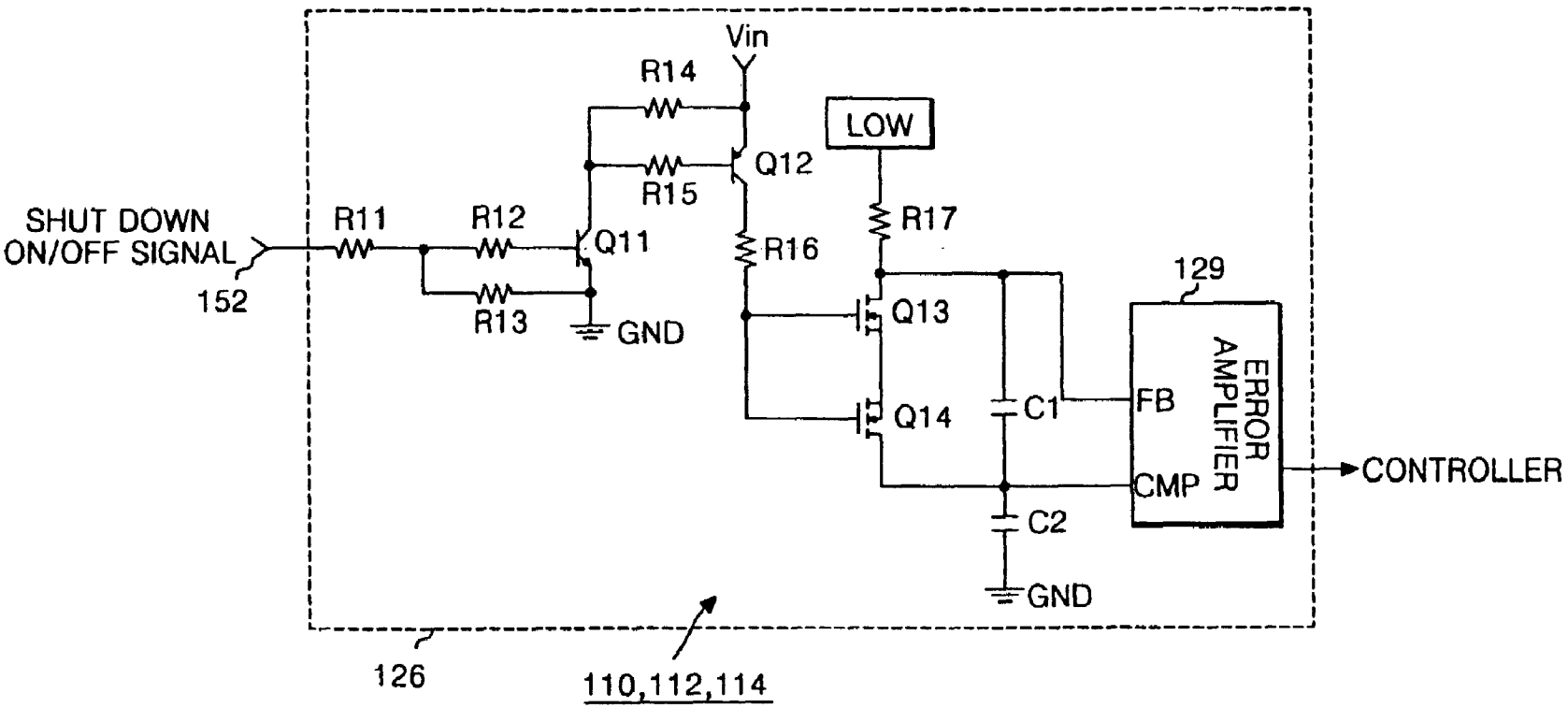
FIG. 7 is a schematic circuit diagram of an exemplary shutdown circuit as shown in FIG. 5 according to the present invention.

FIG. 7 is a schematic circuit diagram of an exemplary shutdown circuit as shown in FIG. 5 according to the present invention. In FIG. 7, each of the first, second, and third inverters 110, 112, and 114 (in FIG. 5) includes a shutdown circuit 126 that receives voltages input through the low path by the shutdown ON/OFF signals to monitor the presence or absence of a malfunctioning one of the first, second, and third backlight lamps 116, 118, and 120 (in FIG. 5).

In FIG. 7, the shutdown circuit 126 may include a first resistor R11 and a second resistor R12 connected in series between a second input terminal 152 and a base terminal of a first transistor Q11, a third resistor R13 connected to an emitter terminal of the first transistor Q11 and a connection node between the first and second resistors R11 and R12, a fifth resistor R15 connected between a collector terminal of the first transistor Q1 and a base terminal of a second transistor Q12, a fourth resistor R14 connected between the collector terminal of the first transistor Q11 and an emitter terminal of the second transistor Q12 such that the emitter terminal of the second transistor Q12 is connected to the input voltage Vin, a sixth resistor R16 connected to a collector terminal of the second transistor Q12 and gate terminals of first and second field effect transistors Q13 and Q14, a seventh resistor R17 connected to the low path of the backlight lamp to be connected to a source terminal of the first field effect transistor Q13 such that a source terminal of the second field effect transistor Q14 is connected to the source terminal of the first field effect transistor Q13 and a drain terminal of the second field effect transistor Q14 is connected to a comparison terminal CMP of an error amplifier 129, a second capacitor C2 connected between ground GND and the drain terminal of the second field effect transistor Q14, a first capacitor C1 connected between a drain terminal of the first field effect transistor Q13 and the drain terminal of the second field effect transistor Q14, wherein the drain terminal of the first field effect transistor Q13 is connected to a feedback FB terminal of the error amplifier 129.

With respect to FIGS. 5 and 6, operation of the inverter of the liquid crystal display according to the present invention includes the first, second, and third inverters 110, 112, and 114 receiving and converting the inverter drive voltage Vin into the lamp drive voltage as an alternating current. Then, the lamp drive voltage is individually supplied to the high path of the first, second, and third backlight lamps 116, 118, and 120. The first, second, and third inverters 110, 112, and 114 controls the low path and disable the shutdown function of the first, second, and third backlight lamps 116, 118, and 120 except for the backlight lamp that exhibits a malfunction in response to the inverter ON/OFF signal and the shutdown ON/OFF signal.

In FIG. 6, the first, second, and third backlight lamps 116, 118, and 120 and the operation of controlling the shutdown function includes, during operation of the first inverter 110, supplying the inverter drive voltage Vin to a transformer 122 in order to convert the input DC voltage into an AC voltage. Accordingly, the AC voltage is supplied to the high path HIGH of the first backlight lamp 116. Then, the current passing through the first backlight lamp 116 flows to the low path LOW, wherein the current flowing to the low path LOW is fed back to the first, second, and third inverters 110, 112, and 114.

During operation of the second inverter 112, the inverter drive voltage Vin is supplied to a transformer 122 in order to convert the input DC voltage into an AC voltage. Accordingly, the AC voltage is supplied to the high path HIGH of the second backlight lamp 118. Then, the current passing through the second backlight lamp 118 flows to the low path LOW, wherein the current flowing to the low path LOW is fed back to the first, second, and inverters 110, 112, and 114.

During operation of the third inverter 114, the inverter drive voltage Vin is supplied to a transformer 122 in order to convert the input DC voltage into an AC voltage. Accordingly, the AC voltage is supplied to the high path HIGH of the third backlight lamp 120. Then, the current passing through the third backlight lamp 120 flows to the low path LOW, wherein the low path LOW is fed back to the first, second, and third inverters 110, 112, and 114.

Monitoring for the presence or absence of a malfunctioning one of the first, second, and third backlight lamps includes supplying the inverter ON signal and the shutdown ON signal to the first inverter 110 while supplying the inverter OFF signal and the shutdown OFF signal to the second and third inverters 112 and 114.

For example, when a high signal of about 5V, which is the inverter ON signal, is input to a first input terminal 150 of the first inverter 110, the high signal is supplied to the base terminal of the first transistor Q1 through the first and second resistors R1 and R2 of the low path switching part 124. Accordingly, the first transistor Q1 is turned ON, which turns ON the second transistor Q2, and the first and second field effect transistors Q3 and Q4 are turned ON. Thus, the low path LOW of the first backlight lamp 116 is connected to ground GND, thereby turning the first backlight lamp 1160N.

Conversely, when a low signal of about 0V, which is the shutdown ON signal, is input to a second input terminal 152 of the first inverter 110, the low signal is supplied to the base terminal of the first transistor Q11 through the resistors R11 and R12 of the shutdown circuit 126. Accordingly, the first transistor Q11 is turned OFF, which causes the second transistor Q12 to be turned OFF, and the first and second field effect transistors Q13 and Q14 are turned OFF. Thus, the comparison terminal CMP of the error amplifier 129 is supplied with a voltage integrated by the seventh resistor R17 and the first and second capacitors C1 and C2. The error amplifier 129 compares the voltage set in advance with the voltage input through the comparison terminal CMP to detect if there is a malfunction in the first backlight lamp 116. In addition, the feedback terminal FB and the comparison terminal CMP of the error amplifier 129 is not be shorted, thus the shutdown function is enabled to check if there is a malfunction in the first backlight lamp 116.

On the other hand, since the inverter OFF signal and the shutdown OFF signal are supplied to the second and third inverters 112 and 114, the third inverter 114 has the same operation as the second inverter 112. Accordingly, operation of the third inverter 114 is omitted.

When a low signal of about 0V, which is the inverter OFF signal, is input to a first input terminal 150 of the second inverter 112, the low signal is supplied to the base terminal of the first transistor Q1 through the first and second resistors R1 and R2 of the low path switching part 124. Accordingly, the first transistor Q1 is turned OFF, which causes the second transistor Q2 to be turned OFF, and the first and second field effect transistors Q3 and Q4 are turned OFF. Thus, the low path LOW of the second backlight lamp 118 is intercepted from ground GND to allow the second backlight lamp 118 to be turned OFF.

When a high signal, which is the shutdown OFF signal, as shown in FIG. 7, is input to a second input terminal 152 of the second inverter 112, the high signal is supplied to the base terminal of the first transistor Q11 through the resistors R11 and R12 of the shutdown circuit 126. Accordingly, the first transistor Q11 is turned ON, which causes the second transistor Q12 to be turned ON, and the first and second field effect transistors Q13 and Q14 are turned ON. Accordingly, the comparison terminal CMP of the error amplifier 129 is shorted with the feedback terminal FB, thus the voltage integrated by the seventh resistor R17 and the first and second capacitors C1 and C2 is not be supplied to the comparison terminal CMP. Thus, the error amplifier 129 is disable the shutdown function that is used for detecting if there is a malfunction in the second backlight lamp 116.

Therefore, only the first inverter 110 is driven and the second and third inverters 112 and 114 are not driven, so the presence or absence of a malfunction may be monitored by way of turning ON only the first backlight lamp 116.

Similarly, the second inverter 112 and the third inverter 114 is selectively driven to turn ON the second backlight lamp 118 or the third backlight lamp 120 in response to the inverter ON/OFF signal and the shutdown ON/OFF signal, thereby monitoring for the presence or absence of a malfunction of the second or third backlight lamps 118 and 120.

Figure 8:
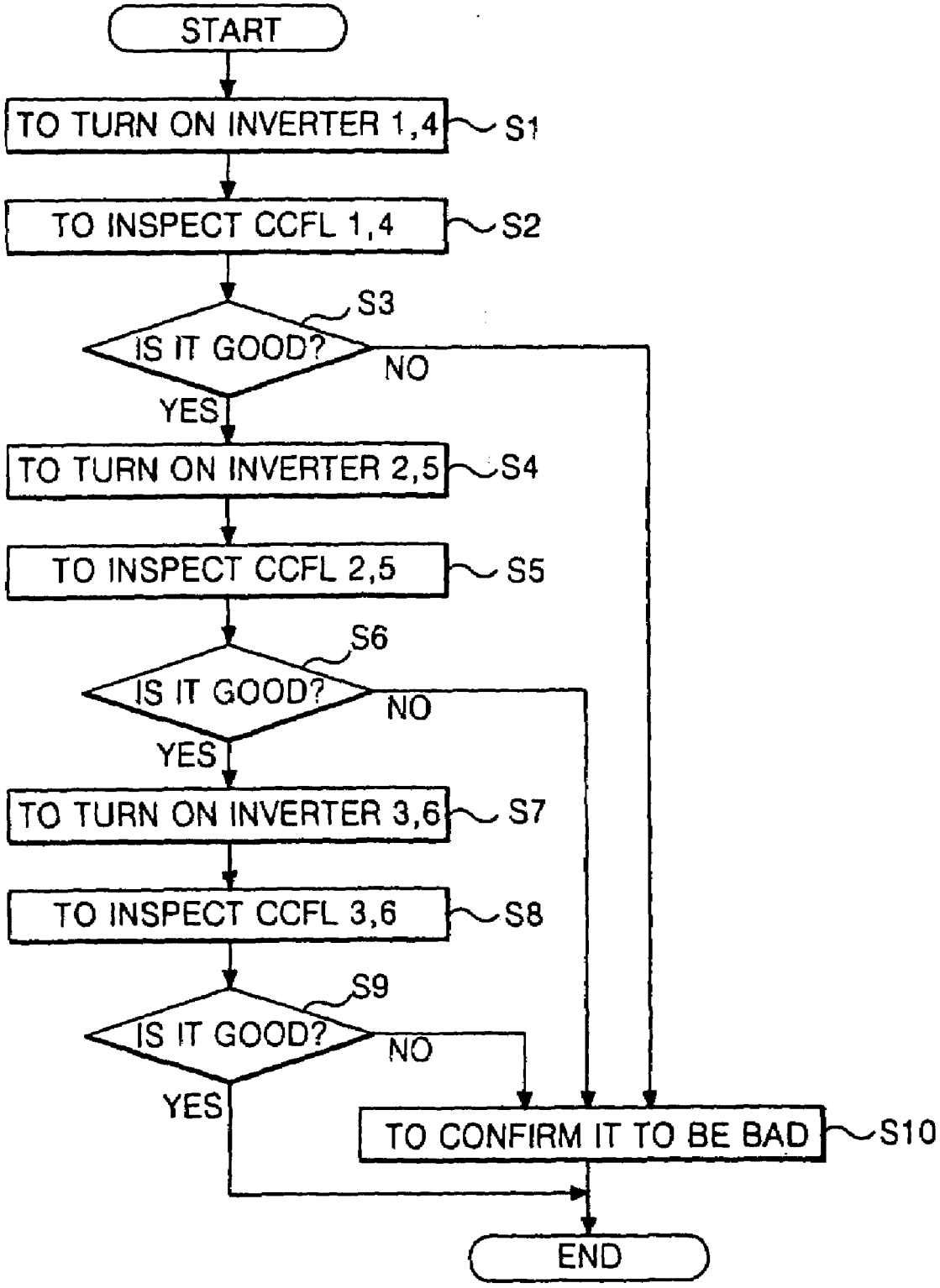
FIG. 8 is a flow chart of an exemplary checking sequence of a backlight-checking device according to the present invention.

FIG. 8 is a flow chart of an exemplary checking sequence of a backlight-checking device according to the present invention. In FIG. 8, six backlight lamps are monitored using a backlight lamp monitoring device of a liquid crystal display. The backlight lamp monitoring device monitors two up-and-down adjacent backlight lamps to reduce monitoring time of the backlight lamps.

In a step S1, the inverter ON/OFF signal and the shutdown ON/OFF signal enables first and fourth inverters to be selectively driven.

In a step S2, the driving of the first and fourth inverters turn ON first and fourth backlight lamps to check for the presence or absence of a malfunction.

In a step S3, a determination whether the first and fourth backlight lamps are properly functioning or malfunctioning is made in accordance with results of the step S2.

In a step S4, if the determination results are favorable (i.e., yes), the inverter ON/OFF signal and the shutdown ON/OFF signal enables second and fifth inverters to be selectively driven.

In step S5, the driving of the second and fifth inverters turns ON second and fifth backlight lamps to check for the presence or absence of a malfunction.

In step S6, the second and fifth backlight lamps are determined to be good (i.e., properly functioning) in accordance with result of step S5.

In step S7, if the determination results are favorable (i.e., yes), the inverter ON/OFF signal and the shutdown ON/OFF signal enables third and sixth inverters to be selectively driven.

In step S8, the driving of the third and sixth inverters turns ON third and sixth backlight lamps to check for the presence or absence of a malfunction.

In step S9, the third and sixth backlight lamps are determined to be properly functioning or malfunctioning in accordance with results of step S8.

In step S10, if the determination results are favorable (i.e., properly functioning), the first, second, third, fourth, fifth, and sixth backlight lamps are confirmed to be properly functioning. Alternatively, if the determination results in steps S3, S6, and S9 are not favorable, all the first, second, third, fourth, fifth, and sixth backlight lamps are determined to be malfunctioning.

In the inverter device and liquid crystal display device using the inverter device according to the present invention, there is an advantage in that the low path of the inverters is selectively intercepted and the shutdown function thereof is enabled to turn ON only selected ones of the backlight lamps, thereby monitoring the presence or absence of a malfunction. In addition, the present invention further has an advantage in that all lamps are simultaneously turned ON or OFF regardless of the channel configuration of the backlight lamps.

It will be apparent to those skilled in the art that various modifications and variations can be made in the inverter device, liquid crystal display device using the inverter device, and method of monitoring lamps of the liquid crystal display device using the inverter device of the present invention without departing from the spirit or scope of the invention. Thus, it is intended that the present invention cover the modifications and variations of this invention provided they come within the scope of the appended claims and their equivalents.

What is claimed is:

1. An inverter device for a liquid crystal display, comprising:

a transformer for receiving an inverter drive voltage, converting the received drive voltage into an AC lamp drive voltage and supplying the AC lamp drive voltage to a high path of one of a plurality of backlight lamps;

a low path switching part connecting or disconnecting a low paths of the backlight lamps with a ground voltage source in response to an external inverter ON/OFF signal, wherein the low path switching part includes a first driver selectively supplying the inverter drive voltage to the low paths of the backlight lamps in response to the inverter ON/OFF signal, and a first switching part connecting the low paths of the backlight lamps to the ground voltage source in response to an output signal of the first driver; and a shutdown circuit for receiving a voltage input through the low paths of the backlight lamps to monitor for a malfunction of the backlight lamps in response to an external shutdown ON/OFF signal, wherein the first driver includes a first switch being switched in response to the inverter ON/OFF signal, and a second switch supplying the inverter drive voltage to the first switching part in response to a state of the first switch, wherein the first switching part includes first and second transistors connected in series between the low path of the backlight lamp and the ground voltage source for connecting the low path of the backlight lamp to the ground voltage source in response to an output signal of the second switch, and a resistor connected between the low path of the backlight lamp and the first transistor.

2. An inverter device for a liquid crystal display, comprising:

a transformer for receiving an inverter drive voltage, converting the received drive voltage into an AC lamp drive voltage and supplying the AC lamp drive voltage to a high path of one of a plurality of backlight lamps;

a low path switching part connecting or disconnecting a low paths of the backlight lamps with a ground voltage source in response to an external inverter ON/OFF signal; and a shutdown circuit for receiving a voltage input through the low paths of the backlight lamps to monitor for a malfunction of the backlight lamps in response to an external shutdown ON/OFF signal, wherein the shutdown circuit includes a second driver selectively supplying the inverter drive voltage to the low paths of the backlight lamps in response to the shutdown ON/OFF signal, a second switching part providing one of an enabling and disabling shutdown function for monitoring for the presence or absence of a malfunction of the backlight lamps in response to an output signal of the second driver, and an error amplifier monitoring for the presence or absence of a malfunction of the backlight lamps when the shutdown function is enabled by the second switching part, wherein the second driver includes a third switch being switched in response to the shutdown ON/OFF signal; and a fourth switch supplying the inverter drive voltage to the second switching part in response to a state of the third switch, wherein the second switching part includes, third and fourth field effect transistors connected in series between the low paths of the backlight lamps and the ground voltage source for connecting the low paths of the backlight lamps to the ground voltage source in response to an output signal of the fourth switch, and a resistor connected between the low path of the backlight lamp and the third field effect transistor, wherein the second switching part includes a first capacitor connected between a drain terminal of the third field effect transistor and a drain terminal of the fourth field effect transistor, and a second capacitor connected between the drain terminal of the fourth field effect transistor and the ground voltage source.

* * * * *